US012152334B2

(12) United States Patent
Kim et al.

(10) Patent No.: US 12,152,334 B2
(45) Date of Patent: Nov. 26, 2024

(54) CLOTHING TREATMENT APPARATUS

(71) Applicant: LG ELECTRONICS INC., Seoul (KR)

(72) Inventors: Beomjun Kim, Seoul (KR); Hyunwoo Noh, Seoul (KR); Sangwook Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 249 days.

(21) Appl. No.: 17/912,785

(22) PCT Filed: Mar. 19, 2021

(86) PCT No.: PCT/KR2021/003455

§ 371 (c)(1),
(2) Date: Sep. 19, 2022

(87) PCT Pub. No.: WO2021/187957

PCT Pub. Date: Sep. 23, 2021

(65) Prior Publication Data

US 2023/0145222 A1 May 11, 2023

(30) Foreign Application Priority Data

Mar. 20, 2020 (KR) ..... 10-2020-0034396
Mar. 19, 2021 (KR) ..... 10-2021-0036163

(51) Int. Cl.

| | |
|---|---|
| ***D06F 58/10*** | (2006.01) |
| ***D06F 58/02*** | (2006.01) |
| ***D06F 58/26*** | (2006.01) |

(52) U.S. Cl.
CPC ..... *D06F 58/10* (2013.01); *D06F 58/02* (2013.01); *D06F 58/26* (2013.01)

(58) Field of Classification Search
CPC ..... D06F 58/10
See application file for complete search history.

(56) References Cited

FOREIGN PATENT DOCUMENTS

| | | | |
|---|---|---|---|
| KR | 10-2007-0105788 | A | 10/2007 |
| KR | 10-2013-0074790 | A | 7/2013 |
| KR | 10-2016-0072604 | A | 6/2016 |
| KR | 10-2018-0023277 | A | 3/2018 |
| KR | 10-2019-0097596 | A | 8/2019 |

*Primary Examiner* — Jason Y Ko
(74) *Attorney, Agent, or Firm* — Birch, Stewart, Kolasch & Birch, LLP

(57) ABSTRACT

A clothing treatment apparatus includes a cabinet having an inlet; a door provided in the cabinet to open and close the inlet; a drum rotatably disposed inside the cabinet, and having an elongated cylindrical shape; a tubular extension part extending from the inlet of the cabinet toward the drum; a first duct provided outside the drum; an induction heater which includes a coil, is provided inside the first duct, and heats the drum; a first fan supplying outside air to the inside of the first duct; and a second duct having an inlet connected to the first duct, extending from the first duct along a radially inward direction of the drum, and having an outlet connected to an outer circumferential surface of the extension part. The outlet of the second duct may have a smaller area than the area of the inlet.

20 Claims, 9 Drawing Sheets

CLOTHING TREATMENT APPARATUS

CROSS REFERENCE TO RELATED APPLICATIONS

This application is the National Stage filing under 35 U.S.C. 371 of International Application No. PCT/KR2021/003455, filed on Mar. 19, 2021, which claims priority under 35 U.S.C. 119(a) to Patent Application Nos. 10-2020-0034396, filed in the Republic of Korea on Mar. 20, 2020 and 10-2021-0036163, filed in the Republic of Korea on Mar. 19, 2021, all of which are hereby expressly incorporated by reference into the present application.

TECHNICAL FIELD

The disclosure relates to a clothing treatment apparatus.

BACKGROUND ART

Generally, a clothing treatment apparatus may include a washing machine, a dryer, an apparatus for refreshing clothing, etc. The washing machine may be a washer-dryer combo having a drying function.

The washing machine removes contaminants from laundry accommodated in a drum by rotating the drum in a tub where water is stored. The washing machine may be provided with a heating means for heating water or drying laundry.

The dryer rotates the drum in a cabinet and applies heat to laundry in the drum to dry the laundry.

The clothing treatment apparatus may include a heating means for heating or drying laundry. The clothing treatment apparatus may be provided with an electric heater or a heat pump as the heating means.

Meanwhile, a drying process commonly uses a conventional hot-air drying method in which laundry is dried by heating air that circulates in a tub and an external circulation path. This has used a method in which air is heated by arranging a heating wire on the path in which air circulates.

In order to use the above-described hot-air drying method, a gas heater or an electric heater capable of heating the heating wire is required. The gas heater has problems concerning safety and exhaust gas, while the electric heater has problems in that foreign substances such as scale may be accumulated and excessive energy may be consumed.

Further, there is a low-temperature dehumidifying and drying method using a heat pump as well as the above-described hot-air drying method. The heat pump uses the cooling cycle of an air conditioner in reverse, and thus requires components such as an evaporator, a condenser, an expansion valve, and a compressor.

Moreover, the above hot-air drying method and low-temperature dehumidifying and drying method have drawbacks in that they are an indirect drying method using air, so that a drying time may be prolonged when laundry is agglomerated or contains a lot of moisture.

Recently, research on an induction module (or induction heater) as a new heating means is being conducted.

A coil may be wound around an induction module that is provided in the clothing treatment apparatus such as a washing machine or a dryer, and heat may be transferred to a heating object (drum of the washing machine) by induced current that is generated by applying current to the coil.

Since the induction module may heat the drum, the clothing treatment apparatus equipped with the induction module may dry the laundry even if the apparatus is not provided with a circulation duct that guides air discharged from a tub applied to the clothing treatment apparatus operated in the hot-air drying method into the tub again.

However, the clothing treatment apparatus having no circulation duct is problematic in that lint may be accumulated in the rear surface of a cabinet door, the front of the tub, the gasket or the like during a drying operation.

Korean Patent Laid-Open Publication No. 10-2018-0023276 (2018. Mar. 7.) has disclosed a clothing treatment apparatus equipped with an induction portion. However, the cited document is problematic in that there is no structure for the air flow of the clothing treatment apparatus equipped with the induction module, so that lint may be accumulated in the rear surface of the cabinet door, the front of the tub, the gasket or the like as described above. Even if the drum is directly inductively heated through a magnetic field generated by the induction portion and the heated air is discharged to the outside of the tub, the flow of air introduced from the front of the tub is not formed, so that the above-described problem in which the lint is accumulated cannot be prevented.

Further, the cited document does not disclose a structure for cooling the induction module. The heat generated when current flows through the coil of the induction module may cause the deterioration of the coil, thus degrading the performance of an induction heating module.

SUMMARY

The present disclosure aims to solve the above and other problems.

Another objective is to provide a clothing treatment apparatus, such as a dryer, a washing machine, a washer-dryer combo an apparatus for refreshing clothing, which is provided with an induction heater.

A further objective is to provide a clothing treatment apparatus that reduces power consumption during drying.

Another objective is to provide a clothing treatment apparatus that supplies air to the inside of a drum in a simple structure.

Another objective is to provide a clothing treatment apparatus that removes lint accumulated in a door, a tub, a gasket or the like.

Another objective is to provide a clothing treatment apparatus that prevents lint from being accumulated in a door, a tub, a gasket or the like.

Another objective is to provide a clothing treatment apparatus that prevents a coil of an induction heater from being overheated.

In order to accomplish the above objectives, a clothing treatment apparatus according to an aspect of the present disclosure includes a drum, a duct that is provided outside the drum, and an induction heater that heats the drum and is disposed inside the duct.

The clothing treatment apparatus includes a cabinet including an inlet. The inlet may be provided in the front surface of the cabinet.

The drum may be rotatably disposed in the cabinet. The drum may have an opening that faces the inlet of the cabinet. The drum may have an elongated cylindrical shape. The drum may be formed of metal.

The clothing treatment apparatus may include a tubular extension portion extending from the inlet of the cabinet toward the drum.

The clothing treatment apparatus may include a first duct that is provided outside the drum.

The clothing treatment apparatus may include an induction heater that heats the drum. The induction heater may be disposed in the first duct. The induction heater may include a coil.

The clothing treatment apparatus may include a first fan that supplies outside air to the inside of the first duct. Here, the term "outside air" may mean air that is present between the cabinet and the drum. Further, in the case of the clothing treatment apparatus including a tub that will be described later, the term "outside air" may mean air that is present between the cabinet and the tub.

The clothing treatment apparatus may include a second duct connected to the first duct. The second duct may have an inlet connected to the first duct. The second duct may extend from the first duct along a radially inward direction of the drum. The second duct may have an outlet connected to the outer circumference of the extension portion.

In the second duct, an area of the outlet may be smaller than an area of the inlet.

Thus, air supplied through the second duct may serve as an air curtain in front of the opening of the drum. That is, lint separated from laundry in the drum can be prevented from being accumulated in the door, the front surface of the tub, or a gasket that will be described later, and can remove the accumulated lint.

The second duct may have a first width defined in the longitudinal direction of the drum, and a second width defined in the radial direction of the drum. The first width of the second duct may be smaller than the second width of the second duct.

Thus, air supplied through the second duct may flow into the extension portion to be wide in the radial direction of the drum and be thin in the width direction of the drum.

The first width of the outlet of the second duct may be smaller than the first width of the inlet of the second duct.

The clothing treatment apparatus may further include a fan housing that receives the fan and communicates with the first duct.

The fan housing may be located on the opposite side of the second duct with respect to the center of the first duct.

The first duct may be located on the upper side of the drum, the second duct may extend downward from the first duct, and the fan housing may be located on the upper side of the first duct.

The second duct may be located on the opposite side of the fan housing with respect to the center in the longitudinal direction of the first duct.

The clothing treatment apparatus may include an exhaust port communicating with the inside of the drum.

The clothing treatment apparatus may further include a third duct communicating with the exhaust port and the outside of the cabinet.

The clothing treatment apparatus may be a dryer. The clothing treatment apparatus may be dryer having no tub.

The clothing treatment apparatus may be a washer-dryer combo that performs washing and drying operations. The clothing treatment apparatus may be a washer-dryer combo having the tub.

The tub may be provided in the cabinet. The tub may provide a space that holds water. The drum may be disposed in the tub. The tub may have an opening that faces the inlet of the cabinet.

The first duct may be mounted on the outer surface of the tub.

The extension portion may include a gasket that connects the inlet of the cabinet and the opening of the tub.

The outlet of the second duct may be connected to the outer circumference of the gasket.

The exhaust port may be disposed in the tub.

The clothing treatment apparatus may further include a fan motor that rotates the fan.

The clothing treatment apparatus may further include a drum motor (or driving unit) that rotates the drum.

The clothing treatment apparatus may include a controller that controls the fan motor, the drum motor, and the induction heater.

The controller may drive the induction heater, and may rotate the fan through the fan motor at a rotation speed that is smaller than a preset first rotation speed. After the fan is rotated at the speed that is smaller than the first rotation speed, the controller may rotate the fan through the fan motor at a second rotation speed that is larger than the first rotation speed. For example, the first rotation speed may be in the range of 60 to 100 rpm. For example, the first rotation speed may be 60 rpm. For example, the second rotation speed may be in the range of 100 to 200 rpm. For example, the second rotation speed may be 200 rpm.

The controller may rotate the fan through the fan motor at the second rotation speed on the basis of information received from a sensor disposed in the tub. The information received from the sensor may be information related to the moisture content of laundry in the drum.

The clothing treatment apparatus may further include a first temperature sensor that is disposed on the upper portion of the tub inside the tub, and a second temperature sensor that is disposed on the lower portion of the tub inside the tub.

The controller may rotate the fan through the fan motor at the second rotation speed on the basis of information received from the first temperature sensor and information received from the second temperature sensor. The controller may determine humidity in the tub on the basis of the information received from the first temperature sensor and the information received from the second temperature sensor. The controller may determine the moisture content of laundry in the drum on the basis of the information received from the first temperature sensor and the information received from the second temperature sensor.

The controller may rotate the fan through the fan motor at the second rotation speed on the basis of the moisture content of the laundry. The controller may rotate the fan at the second rotation speed when the moisture content of the laundry is smaller than a reference value. For example, the reference value may be in the range of 5% to 18%. For example, the reference value may be 15%.

The controller may control to rotate the fan through the fan motor at the speed that is equal to or less than the preset first rotation speed. After the fan is rotated at the speed that is equal to or less than the first rotation speed, the controller may control to rotate the fan through the fan motor at a third rotation speed that is faster than the first rotation speed. The controller may control to alternately repeat the rotation of the fan at the first rotation speed or less and the rotation of the fan at the third rotation speed.

For example, the third rotation speed may be in the range of 100 to 200 rpm. The third rotation speed may be smaller than the second rotation speed. For example, the third rotation speed may be 100 rpm.

The controller may rotate the drum so that the centrifugal force acting on the laundry in the drum by the rotation of the drum is larger than the gravity, when the induction heater is driven.

In order to solve the objectives of the present disclosure, various embodiments are intended to a clothing treatment apparatus equipped with an air circulation structure capable of reducing lint that is generated in the door or the gasket of the clothing treatment apparatus to which an IH module is applied.

An exemplary embodiment of the present disclosure is to provide a clothing treatment apparatus, in which an air circulation flow introduced from the front of the tub to the rear of the tub is generated, thus preventing lint from being stacked on the door provided in front of the tub or the gasket.

An exemplary embodiment of the present disclosure is to provide a clothing treatment apparatus equipped with an IH module, in which it is possible to cool the IH module and simultaneously to prevent lint from being stacked on the door or the gasket.

An exemplary embodiment of the present disclosure is to provide a clothing treatment apparatus, which can cool the IH module, dry laundry, and prevent lint from being stacked on the door or the gasket by controlling the driving of the IH module and the driving of the fan for the air circulation flow.

An exemplary embodiment of the present disclosure is to provide a clothing treatment apparatus, which can minimize the generation of lint due to the friction of laundry by controlling the rotation speed of the drum so that the laundry is attached to the inner circumference of the drum, during the drying operation of the clothing treatment apparatus equipped with the IH module.

An exemplary embodiment of the present disclosure is to provide a clothing treatment apparatus, including a cabinet that defines an appearance and has an inlet, a tub that is provided inside the cabinet and forms an opening communicating with the inlet, a drum that is rotatably installed in the tub, receives clothing, and is formed of a metal material, a gasket that connects the inlet of the cabinet and the opening of the tub, a first duct that is provided outside the tub to form a path, a second duct that communicates with the gasket to discharge air to the inner circumference of the gasket, an induction module that is provided inside the first duct and heats the circumferential surface of the drum through a magnetic field generated by applying current, and a first fan that supplies outside air to the inside of the first duct.

The clothing treatment apparatus may further include a third duct that connects the tub and the cabinet to discharge air in the tub to the outside of the cabinet, and may further include a second fan that communicates the third duct and the cabinet.

Further, air introduced into the first duct may be supplied from a gap between the tub and the cabinet.

Further, the tub includes a tub opening and a tub body that forms a main body of the tub, the induction module may be provided on the circumferential surface of the tub body, the first duct may extend from the tub body toward the tub opening, and the second duct may communicate with one end of the first duct and the tub opening outside the tub.

Meanwhile, the clothing treatment apparatus may further include a controller that controls the rotation of the drum and the operation of the induction module and the first fan, and the controller may operate the induction module when the drum rotates, thus heating the drum. The first fan may be controlled to be operated on the basis of the operation of the induction module. The first fan may be controlled to be operated simultaneously when the induction module is operated or after the induction module is operated.

Of course, the first fan may be controlled independently of the induction module.

The drum may be controlled to be rotated at a first RPM at which an object received in the drum may be attached to the inner circumference of the drum for a predetermined time after the induction module is operated, and the drum may be controlled to be rotated at a second RPM that is higher than the first RPM for a predetermined time after the induction module is operated.

During the drying operation of the clothing treatment apparatus, a section where the drum is rotated at the first RPM at which the object received in the drum may be attached to the inner circumference of the drum may be performed at least once.

During the drying operation of the clothing treatment apparatus, a section where the drum is rotated at the second RPM that is higher than the first RPM at which the object received in the drum may be attached to the inner circumference of the drum may be performed at least once.

An exemplary embodiment of the present disclosure is to provide a clothing treatment apparatus, including a cabinet that defines an appearance and has an inlet, a tub that is provided inside the cabinet and forms an opening communicating with the inlet, a drum that is rotatably installed in the tub, receives clothing, and is formed of a metal material, a gasket that is provided between the inlet of the cabinet and a drum opening, an induction module that is provided on the tub to have a gap from the circumferential surface of the drum and heats the circumferential surface of the drum through a magnetic field generated by applying current to a coil, a duct that receives the induction module and forms a path communicating with the opening of the tub, and a fan that is connected to the duct to supply outside air to the induction module, so that the outside air introduced through the fan into the duct cools the induction module and then is guided to the front of the gasket to be discharged toward the gasket.

Each of the features of the above-described embodiments may be implemented in combination with other embodiments unless they are contradictory or exclusive to other embodiments.

Advantageous Effects

In accordance with at least one of embodiments of the present disclosure, an induction heater for heating a drum is included, so that it is possible to reduce power consumption during drying.

Further, an induction heater is disposed in a duct, thus allowing air to be supplied to the inside of a drum with a simple structure.

Further, an outlet of a duct is disposed in front of a drum, so that it is possible to remove lint accumulated in a door, a tub, a gasket or the like, and to prevent the accumulation of lint.

Further, air is supplied through a duct in a time section when a lot of lint is generated during drying, thus preventing the accumulation of the lint.

Further, a flow rate supplied through a duct is controlled, thus maintaining drying performance, removing accumulated lint, and preventing the accumulation of lint.

Further, laundry in a drum is controlled to rotate integrally with the drum without falling from the inner circumference of the drum, thus reducing the generation of lint.

Further, an induction heater is disposed in a duct, thus preventing the induction heater from being overheated.

Further, in a second duct connecting the first duct in which the induction heater is received and a gasket (or, extension portion), an area of an outlet is smaller than that of an inlet, thus forming an air curtain.

Further, in the second duct, a first width defined in a longitudinal direction of a drum is smaller than a second width defined in a radial direction of the drum, thus allowing an air curtain to be formed through wide and fast air flow.

Further, a fan housing is disposed on an opposite side of a second duct, thus improving the cooling efficiency of an induction heater.

DESCRIPTION OF EXEMPLARY EMBODIMENTS

Figure 1:
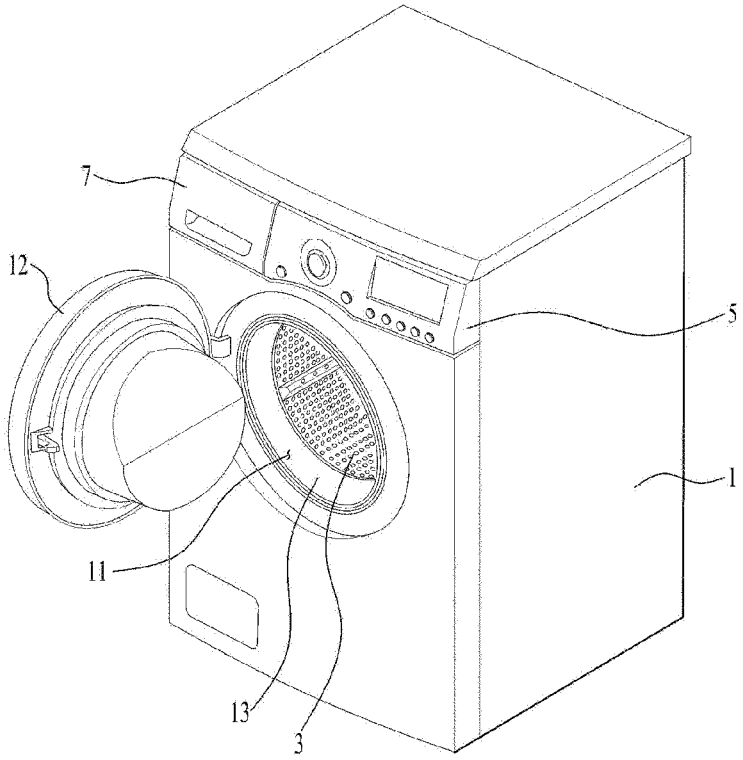
FIG. 1 is a diagram illustrating the appearance of a clothing treatment apparatus according to an embodiment of the present disclosure.

Hereinafter, embodiments of the present disclosure will be described in detail with reference to the accompanying drawings. The same reference numerals are used throughout the drawings to designate the same or similar components, and a duplicated description thereof will be omitted.

The suffixes "module" and "unit" for components used in the following description are given or used in consideration of only the ease of describing the specification, and do not have distinct meanings or roles.

When it is determined that the detailed description of the known art related to an embodiment disclosed in the specification may be obscure the gist of the embodiment, the detailed description thereof will be omitted. Further, it is to be understood that the accompanying drawings are merely for making those skilled in the art easily understand the embodiment disclosed herein, the technical spirit of the present disclosure is not limited to the accompanying drawings, and the present disclosure covers various alternatives, modifications, equivalents and other embodiments that fall within the spirit and scope of the present disclosure.

Although the terms "first", "second", etc. may be used herein to describe various components, these components should not be limited by these terms. These terms are only used to distinguish one component from another component.

It should be understood that when a component is referred to as being "coupled" or "connected" to another component, it can be directly coupled or connected to the other component or intervening components may be present therebetween. In contrast, it should be understood that when a component is referred to as being "directly coupled" or "directly connected" to another component, there are no intervening components present.

Herein, the singular forms are intended to include the plural forms as well, unless the context clearly indicates otherwise.

Furthermore, although each drawing is described for the convenience of description, it is apparent to those skilled in the art that other embodiments may be implemented by combining at least two or more drawings without departing from the scope of the present invention.

Figure 2:
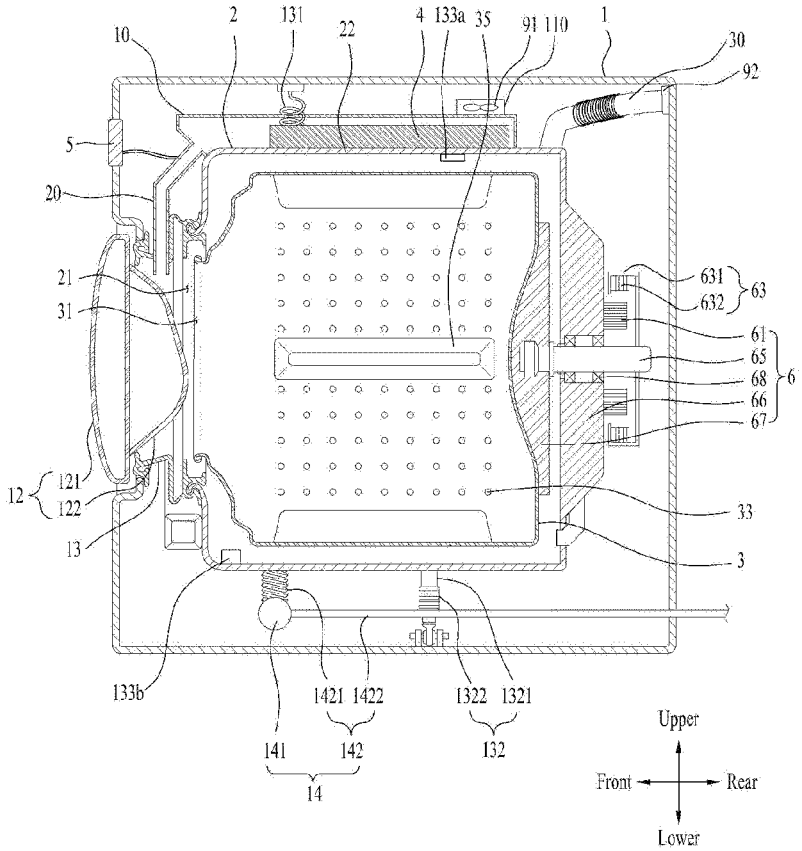
FIG. 2 is a diagram illustrating the internal configuration of the clothing treatment apparatus of FIG. 1.

FIG. 1 is a diagram illustrating the appearance of a clothing treatment apparatus according to an embodiment of the present disclosure, and FIG. 2 is a diagram illustrating the internal configuration of the clothing treatment apparatus of FIG. 1.

Here, when a direction is defined to help the understanding of the detailed structure of the clothing treatment apparatus, a direction facing the door 12 with respect to the center of the clothing treatment apparatus may be defined as a front.

Further, a direction opposite to the direction facing the door 12 may be defined as a rear, and right and left directions may be defined depending on the above-defined front-rear direction.

Hereinafter, the present disclosure will be described with reference to FIGS. 1 and 2.

The clothing treatment apparatus according to an embodiment of the present disclosure may be a washing machine, a dryer, a washer-dryer combo, or a device for refreshing clothing.

The clothing treatment apparatus may be a dryer having no tub 2. Alternatively, the clothing treatment apparatus may be a washer-dryer combo having a tub 2. Hereinafter, the washer-dryer combo will be described as a representative example of the clothing treatment apparatus of the present disclosure. However, the clothing treatment apparatus of the present disclosure is not limited thereto.

The clothing treatment apparatus according to an embodiment of the present disclosure includes a drum 3 and an induction heater 4 (hereinafter referred to as an "induction module") which heats the drum 3. The clothing treatment apparatus may include a cabinet 1 which defines an appearance.

The clothing treatment apparatus may include a tub 2 which is provided in the cabinet 1. The drum 3 may be rotatably provided in the tub 2 to accommodate an object (e.g., a washing object, a drying object, or a refresh object).

For instance, when clothing is washed by washing water, this may be referred to as the washing object. When wet clothing is dried using heat, this may be referred to as the drying object. When dry clothing is refreshed using hot air, cool air or steam, this may be referred to as the refresh object. Thus, clothing may be washed, dried or refreshed through the drum 3 of the clothing treatment apparatus.

The cabinet 1 may include an inlet which is provided in the front of the cabinet 1 to allow the object to be put into and taken out from the cabinet. The cabinet 1 may be provided with a door 12 which is rotatably connected on the cabinet 1 to open or close an inlet.

The door 12 may include a door frame 121 and an inspection window 122 provided on a central portion of the door frame 121.

A detergent box 7 may be provided on the upper portion of the front surface of the clothing treatment apparatus. Detergent, fiber softener, etc. may be supplied through the detergent box 7. The detergent box 7 may be provided with a handle so that a user can slide it toward the front of the cabinet 1 to open or close the detergent box.

A control panel 5 may be provided on the upper portion of the front surface of the clothing treatment apparatus. The control panel 5 may be provided for a user interface. The control panel may perform various user inputs, and display information according to the input and various pieces of information of the clothing treatment apparatus. That is, a manipulation portion for user manipulation and a display for displaying information to a user may be provided on the control panel 5.

The tub 2 is provided in a cylindrical shape with a longitudinal axis thereof being parallel to a lower surface of the cabinet 1 or forming a predetermined angle with the lower surface, thus defining a space in which water may be stored, and has on a front thereof a tub opening 21 to communicate with the inlet. The tub 2 may include the tub opening 21 and a tub body 22 forming the main body of the tub. Therefore, the tub body 22 may be provided in a cylindrical shape, and may be provided with the tub opening 21 to correspond to the shape of the tub body 22.

The tub 2 may be fixed to the lower surface (bottom surface) of the cabinet 1 by a second support portion 132, and the second support portion 132 may be provided with a support bar 1321 and a damper 1322 to attenuate vibration generated in the tub 2 by the rotation of the drum 3.

Further, a first support portion 131 secured to the upper surface of the cabinet 1 may be connected to the upper surface of the tub 2. Through the first support portion 131, vibration generated in the tub 2 and transmitted to the cabinet 1 may be attenuated.

That is, the tub 2 may be supported in the cabinet 1 through the first support portion 131 and the second support portion 132, and vibration generated in the tub 2 may also be attenuated.

The drum 3 may include a body extending in a cylindrical shape. The drum 3 may be made of a conductor. The body of the drum 3 may be made of a conductor. The body of the drum 3 may be formed of metal. A plurality of through holes 33 may be formed in the drum 3.

The drum 3 is provided in a cylindrical shape with a longitudinal axis thereof being parallel to the lower surface (bottom surface) of the cabinet 1 or forming a predetermined angle with the lower surface, thus accommodating the object, and may have on a front thereof a drum opening 31 communicating with the tub opening 21. An angle between the central axis of the tub 2 and the bottom surface may be the same as an angle between the central axis of the drum 3 and the bottom surface. That is, the predetermined angle may mean the same angle.

Further, a plurality of through holes 33 may be formed in the outer circumference of the drum 3 to pass through the drum 3. Through the through holes 33, air and washing water may be introduced between the interior of the drum 3 and the interior of the tub 2.

A lifter 35 may be provided on the inner circumference of the drum 3 to stir the object when the drum 3 is rotated. A plurality of lifters 35 may be provided on the inner circumference of the drum 3 to extend from the inner circumference of the drum 3 in the longitudinal direction of the drum 3.

The drum 3 may be rotated by a driving unit 6 (hereinafter also referred to as a "'drum motor") that is provided on the rear of the tub 2.

The driving unit 6 may include a stator 61 which is secured to the rear surface of the tub 2, a rotor 63 which is rotated by the electromagnetic action with the stator, and a rotating shaft 65 which passes through the rear surface of the tub 2 to connect the drum 3 and the rotor 63.

The stator 61 may be secured to the rear surface of a bearing housing 66 which is provided on the rear surface of the tub 2, and the rotor 63 may include a rotor magnet 632 which is provided on the outside of the stator 61 in the radial direction, and a rotor housing 631 which connects the rotor magnet 632 and the rotating shaft 65.

A plurality of bearings 68 may be provided in the bearing housing 66 to support the rotating shaft 65.

Further, a spider 67 may be provided on the rear surface of the drum 3 to easily transmit the rotating force of the rotor 63 to the drum 3, and the rotating shaft 65 may be secured to the spider 67 to transmit the rotation power of the rotor 63.

Meanwhile, the clothing treatment apparatus according to this embodiment may include a water supply hose (not shown) supplied with water from the outside, and the water supply hose defines a flow path which supplies water to the tub 2.

Further, the clothing treatment apparatus according to this embodiment may include a drain portion 14 which discharges water in the tub 2 to the outside of the cabinet 1. The drain portion 14 may include a drain pipe 142 forming a drain path through which water in the tub 1 moves, and a drain pump 141 which generates a pressure difference in the drain pipe 142 to drain water through the drain pipe 142.

In detail, the drain pipe 142 may include a first drain pipe 1421 which connects the lower surface of the tub 2 and the drain pump 141, and a second drain pipe 1422 which is connected at one end thereof to the drain pump 141 to define a flow path where water moves to the outside of the cabinet 1.

A gasket 13 may be provided between the inlet of the cabinet 1 and the tub opening 21. The gasket 13 connects the tub opening 21 and the inlet 11 provided in the cabinet 1. The gasket 13 serves to prevent water in the tub 2 from leaking into the cabinet 1 and to prevent the vibration of the tub 2 from being transmitted to the cabinet 1.

The gasket 13 may extend from the inlet of the cabinet 1 toward the tub 2 or the drum 3. Hereinafter, the gasket 13 is referred to as an extension portion 13.

A plurality of temperature sensors 133*a* and 133*b* may be provided in the tub 2. The temperature sensors may measure the internal temperature of the tub 2. The upper temperature sensor 133*a* may be located on the upper portion of the tub 2 to measure the temperature of air heated through the induction module 4. The lower temperature sensor 133*b* may be located on the lower portion of the tub 2 to sense the temperature of washing water or wet air. That is, the plurality of temperature sensors may sense whether air has been heated to target temperature by the induction module 4. The driving of the induction module 4 may be controlled by a controller 8 that will be described later on the basis of temperature measured by the temperature sensors.

A sensor may be provided in the tub 2 to detect a state related to the moisture content of laundry in the drum 3. For example, the sensor may be a humidity sensor. For example, the sensor may be the above temperature sensors 133*a* and 133*b*. The controller 8 may determine humidity in the tub 2 on the basis of the temperature detected by the first temperature sensor 133*a* and the temperature detected by the second temperature sensor 133*b*. The controller 8 may determine the moisture content of laundry in the drum on the basis of the temperature detected by the first temperature sensor 133*a* and the temperature detected by the second temperature sensor 133*b*.

Figure 3:
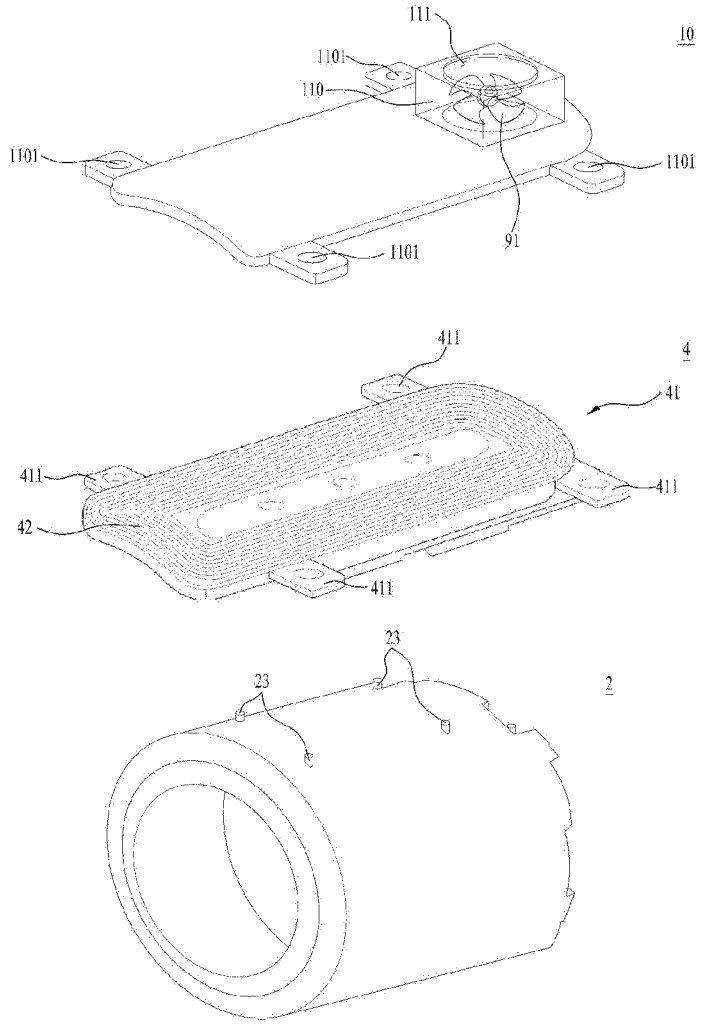
FIG. 3 is a diagram illustrating an induction module, a tub, and a first duct.

FIG. 3 is a diagram illustrating an induction module, a tub, and a first duct. Hereinafter, the present disclosure will be described with reference to FIG. 3.

The clothing treatment apparatus according to an embodiment of the present disclosure may be provided with the induction may be provided with the induction module 4 for inductively heating the drum 3. The induction module 4 may heat the drum 3 to heat washing water or dry laundry. The principle of heating the drum 3 using the induction module 4 is as follows.

The induction module 4 is mounted on the outer circumference of the tub 2, and functions to heat the circumferential surface of the drum 3 through a magnetic field generated by applying a current to the coil 42 around which the wire is wound. The wire may be formed of a core and a coating surrounding the core. The core may be a single core. Of course, a plurality of cores may be entangled to form one core. Thus, the thickness or diameter of the wire may be determined by the thickness of the core and coating.

If an alternating current that is changed in phase flows through the coil 42 around which the wire is wound, the coil 42 forms a radial AC magnetic field according to the Ampere's circuital law.

The AC magnetic field concentrates on the drum (metal material) made of a conductor having high magnetic permeability. The magnetic permeability refers to a degree to which a medium is magnetized with respect to a given magnetic field. At this time, according to Faraday's law of induction, an eddy current is formed in the drum 3. The eddy current flows through the drum 3 made of the conductor, and is converted into Joule heat by the resistance of the drum 3 itself, so that the inner wall of the drum 3 is directly heated.

If the inner wall of the drum 3 is directly heated, the temperature of air in the drum 3 and the temperature of laundry contacting the inner wall of the drum 3 are increased together. Therefore, since the laundry may be directly heated, faster drying is possible compared to a drying apparatus using only a hot-air drying method that is an indirect heating method, or a low-temperature dehumidifying and drying method.

In the case of the clothing treatment apparatus having a washing function, washing water may be heated without a separate heating wire and flow path. Since the washing water continuously contacts the inner and outer walls of the drum 3 heated to a high temperature, it is not necessary to form a separate flow path and heating wire under the tub. According to the above-described method, it is possible to more rapidly heat washing water compared to a method in which the separate flow path and heating wire are formed under the tub and washing water is heated using the flow path and heating wire.

The induction module 4 may include a base housing 41 around which a coil 42 is wound. The base housing 41 may be coupled to a tub body 22. In order to couple the base housing 411 and the tub body 22, the base housing 41 may be provided with a fastening portion 411, and the tub 2 may have a fastening portion 23 at a position corresponding to the fastening portion 411. Further, the first duct 10 may include a fastening portion 1101 that is provided at a position corresponding to the fastening portion 23 of the tub 2 and the fastening portion 411 of the base housing. Therefore, by the above-described fastening structure, the base housing 41 may be coupled to the tub 2, and the first duct 10 may be coupled to the tub 2 while receiving the induction module 4.

A fan housing 110 may be provided on the upper portion of the first duct 10. As described above, the fan housing 110 may be located on the rear side of the tub body 22 in the first duct 10. A first fan 91 is provided in the fan housing 110. The fan housing 110 may be provided with an inlet port 111 for introducing outside air. In order to introduce the outside air through the inlet port 111 into the first duct 10, the fan housing 110 may be provided to pass through the first duct 10.

The fastening structure of the first duct, the induction module, and the tub may be implemented in various shapes. Hereinafter, the fastening structure will be omitted in FIGS. 4 and 5 for the convenience of description.

Figure 4:
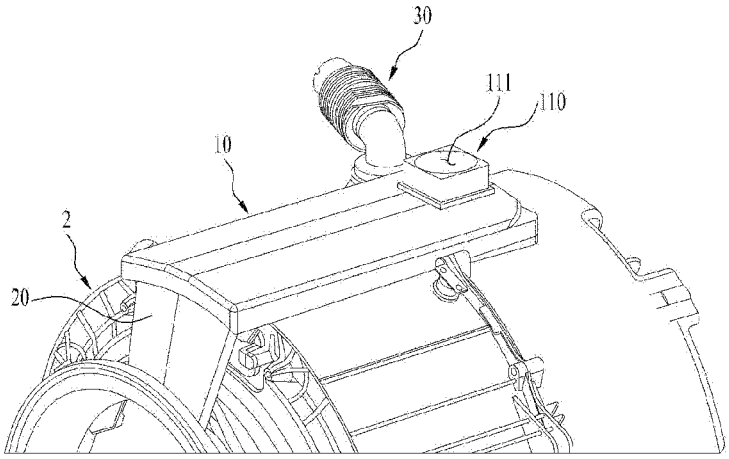
FIG. 4 is a partial, perspective view illustrating an embodiment of the present disclosure.
Figure 5:
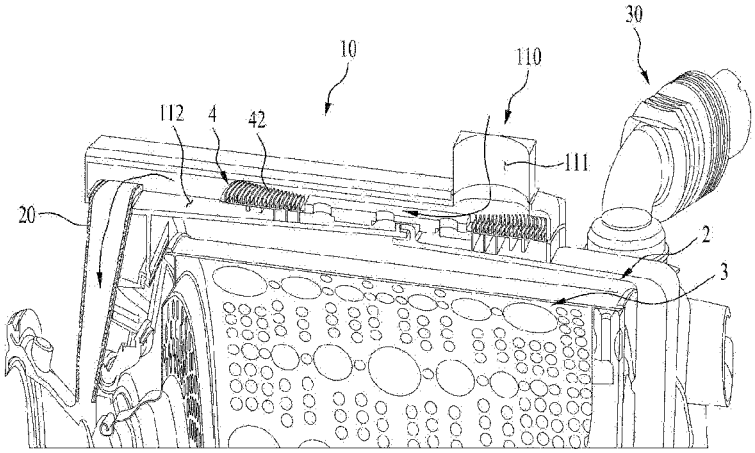
FIG. 5 is a side sectional view of FIG. 4.

FIG. 4 is a partial perspective view illustrating an embodiment of the present disclosure, and FIG. 5 is a side sectional view of FIG. 4. Hereinafter, the present disclosure will be described with reference to FIGS. 4 and 5.

The clothing treatment apparatus of this embodiment provides an air circulation structure for supplying air into the drum while cooling heat generated when current flow through the coil 42.

The first duct 10 of this embodiment may be provided on the upper surface of the outside of the tub 2 to form a path 112 while receiving the induction module 4. The path 112 may mean the flow of air moving in the first duct 10. The induction module 4 may be provided in the first duct 10 to cool the induction module 4.

The induction module 4 is provided on the circumferential surface of the tub body 22, and the first duct 10 receives the induction module 4 and is provided to extend from the rear of the tub body 22 toward the tub opening 21.

The first fan 91 may be configured to form the flow of air moving in the first duct 10. The first fan 91 may be disposed in the first duct 10 or the path connected to the first duct 10. The first duct 10 may supply outside air to the inside of the first duct 10.

A fan motor (not shown) may rotate the first fan 91. The controller 8 may control the fan motor to rotate the first fan 91.

The first fan 91 may be provided on the rear side of the tub body 22 in the first duct 10. Air introduced through the first fan 91 may move along the longitudinal direction of the first duct 10 to be guided to the front of the tub 2.

Therefore, the air introduced by the first fan 91 may flow from the rear side of the tub body 22 to be guided toward the tub opening 21, thus allowing the induction module 4 to be effectively cooled.

One side of the first duct 10 communicates with the second duct 20. The second duct 20 communicates with the first duct 10 and the gasket 13 so that air introduced into the first duct 10 is discharged to the front of the gasket 13.

When the drying operation is performed by the clothing treatment apparatus of this embodiment, lint generated from a drying object is accumulated on the gasket 13 and the tub opening 21.

In the case of the clothing treatment apparatus equipped with the induction module 4 as in this embodiment, a duct having a structure different from the duct for air circulation applied to the conventional clothing treatment apparatus should be applied. This is because the drum 3 is heated through the induction module 4 and thereby a heater member such as a separate heating wire is not required.

To be more specific, the conventional clothing treatment apparatus has on the lower portion of the tub a separate heater member for heating washing water, and a circulation type clothing treatment apparatus applies a structure to the duct extending from the heater member toward the front of the tub. Further, an exhaust type clothing treatment apparatus should be provided with a heater member for heating washing water and a heater member for supplying air of high temperature. In the structure of the conventional clothing treatment apparatus, the high-temperature air is discharged to the duct connected to the front of the tub, thus preventing lint from being accumulated in the gasket.

According to this embodiment, while the induction module is applied, it is possible to increase the volume of the drum by utilizing a space in which the above-described conventional heater member is provided. Therefore, the amount of laundry that may be received is increased compared to the clothing treatment apparatus of the same size, and the amount of lint generated during the drying operation is also increased. Therefore, the clothing treatment apparatus of this embodiment guides high-temperature air to the front of the gasket to remove lint accumulated in the gasket and the tub opening, and a kind of air curtain is formed through the flow of air flowing from the tub opening into the tub body or the drum, thus preventing lint from moving toward the gasket and the tub opening.

The second duct 20 may have an inlet connected to the first duct 10. The second duct 20 may extend from the first duct 10 along a radially inward direction of the drum 3. The second duct 20 may have an outlet connected to the outer circumference of the gasket 13 (or extension portion).

In the second duct 20, the area of the outlet may be smaller than that of the inlet.

The second duct 20 may have a first width defined in the longitudinal direction of the drum 3, and a second width defined in the radial direction of the drum 3. The first width of the second duct 20 may be smaller than the second width of the second duct 20.

The first width of the outlet of the second duct 20 may be smaller than the first width of the inlet of the second duct 20.

Thus, air supplied through the second duct may serve as an air curtain in front of the opening of the drum. That is, it is possible to prevent lint separated from laundry inside the drum from being accumulated in the door, the front surface of the tub, or the gasket that will be described below, and it is possible to remove the accumulated lint.

Thus, air supplied through the second duct may flow into the extension portion to be wide in the radial direction of the drum and be thin in the width direction of the drum.

The second duct 20 may be located on the opposite side of the fan housing 110 with respect to the center of the first duct 10. The first duct 10 may be located on the upper portion of the drum, and the second duct 20 may extend downward from the first duct 10. The second duct 20 may be located on the opposite side of the fan housing 110 with respect to the center in the longitudinal direction of the first duct 10.

As described above, the duct structure of this embodiment can prevent lint from being accumulated and simultaneously cool the induction module 4.

Hereinafter, the flow of air guided by the above-described first duct 10 and second duct 20 will be described.

The air introduced into the first duct 10 cools the induction module 4 received in the first duct 10 while being guided in the longitudinal direction of the first duct 10, and then is guided to the second duct 20.

The second duct 20 communicates with the first duct 10 and the gasket 13 to discharge air guided to the second duct 20 toward the front of the gasket 13.

The air discharged to the second duct 20 passes through the tub opening 21 in front of the gasket 13 and then is introduced into the internal space of the tub 2 or the internal space of the drum 3.

Thus, the air discharged to the second duct 20 may remove lint accumulated on the gasket 13 and the tub opening 21, and may prevent the lint from being moved toward the gasket 13 and the tub opening 21.

The air introduced into the internal space of the tub 2 or the internal space of the drum 3 may be discharged through the third duct 30 to the outside of the cabinet 1.

The third duct 30 connects the tub 2 and the cabinet 1 to discharge air in the tub 2 to the outside of the cabinet 1. Further, in order to prevent lint from being accumulated in the third duct 30, a second fan 92 may be provided to communicate with the third duct 30 and the cabinet 1.

Of course, even if the air flow guided through the second fan 92 to the third duct 30 and then discharged is not created, high-temperature air passing through the drum 3 may be guided to the third duct 30 and discharged to the outside of the cabinet 1.

However, in this case, relatively heavy lint may not be discharged to the outside but may be accumulated in the third duct 30. Therefore, it is possible to prevent lint from being accumulated in the third duct 30 by forming stronger air flow through the second fan 92.

Meanwhile, the air introduced into the first duct 10 through the first fan 91 may be supplied from a gap between the tub 2 and the cabinet 1.

Figure 6:
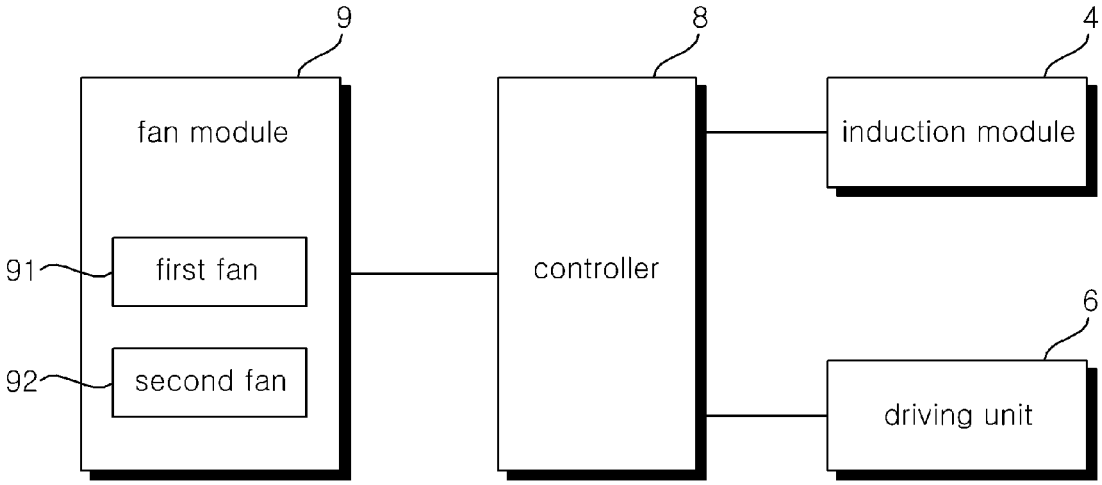
FIG. 6 is a block diagram of control components applicable to the clothing treatment apparatus according to an embodiment of the present disclosure.

FIG. 6 is a block diagram of control components applicable to the clothing treatment apparatus according to an embodiment of the present disclosure. Hereinafter, the present disclosure will be described with reference to FIGS. 4 to 6.

The components for controlling the clothing treatment apparatus of this embodiment may include the controller 8, the induction module 4, the driving unit 6, and the fan module 9. Of course, all components of the clothing treatment apparatus are not controlled by the above-described components. For instance, the plurality of temperature sensors 133*a* and 133*b* provided in the tub may also transmit temperature information by the controller 8, and the controller 8 may control the induction module 4, the driving unit 6, and the fan module 9 on the basis of the temperature information measured by the temperature sensors. However, some control components will be omitted for the convenience of description.

The controller 8 may control the driving unit 6 to rotate the drum 3, and may operate the induction module 4 when the drum 3 rotates, thus heating the drum 3.

It is preferable that the induction module 4 is operated after the drum 3 rotates. This is because the drum 3 may be locally heated when the induction module 2 is operated in a state where the drum 3 is stopped. If the drum 3 is locally heated, this may cause damage to the object received in the drum or cause damage to peripheral electronic devices of the induction module 4. Therefore, the induction module 4 is preferably operated after the drum 3 is rotated at a predetermined RPM so as to prevent the drum 3 from being locally heated.

However, the induction module 4 is not necessarily operated only after the drum 3 rotates. The induction module 4 may be operated independently of the rotation of the drum 3 so as to dry the inside of the drum 3 according to the operation mode of the clothing treatment apparatus.

Figure 10:
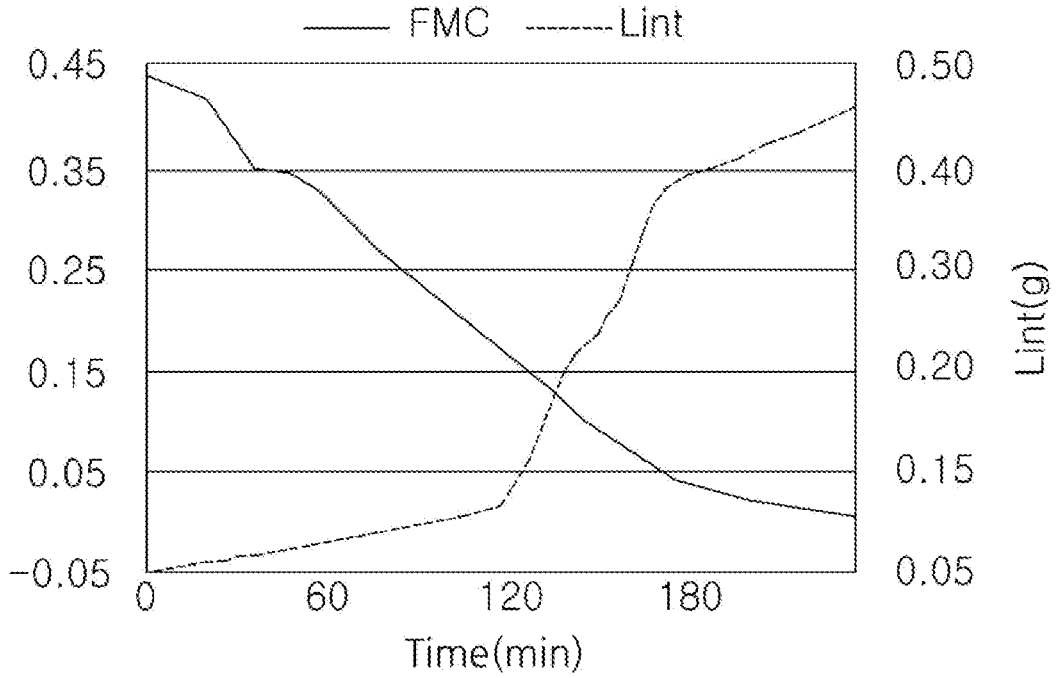
FIG. 10 is a graph illustrating a relationship between a fiber moisture content of laundry and an amount of lint separated from the laundry.

Referring to FIG. 10, as the drying operation is performed, the fiber moisture content (FMC) of laundry is decreased (i.e. the laundry is dried), and the amount of generated lint is increased.

In particular, lint is rapidly generated after the middle of the drying operation. For example, a lint generation rate is rapidly increased at about 120 minutes in FIG. 10.

Further, lint is slowly generated in the latter part of the drying operation. For example, the lint generation rate is decreased at about 180 minutes in FIG. 10.

From this, a correlation between the drying degree of laundry and the lint generation rate may be found. For example, when the fiber moisture content is in the range of 18% to 5%, a lint amount may be dramatically increased. For example, as drying proceeds, the fiber moisture content may be reduced. When the fiber moisture content is 15%, the generation of lint may be dramatically increased.

The controller 8 may control the rotation speed of the fan motor on the basis of the fiber moisture content. When the fiber moisture content is 15%, the controller 8 may rotate the fan motor at high speed.

Figure 11:
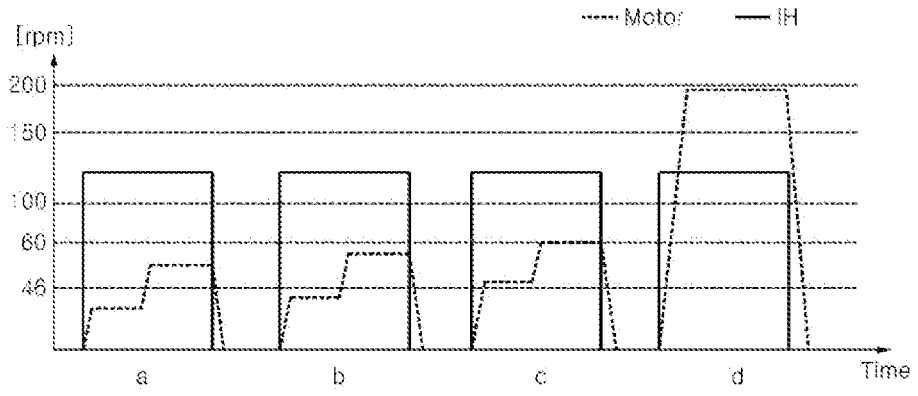
FIG. 11 is a graph illustrating a control method of a clothing treatment apparatus according to an embodiment of the present disclosure, and is a graph illustrating the control of a fan motor that removes accumulated lint.

Referring to FIG. 11, the controller 8 may drive the induction heater 4 to rotate the fan 91 and thereby perform the drying operation. The driving and stopping of the induction heater 4 may be repeated. Further, the rotation and stopping of the fan 91 may be repeated. The driving of the induction heater 4 and the rotation of the fan 91 may be performed in the same time section.

Meanwhile, the fan 91 applied to the clothing treatment apparatus according to an embodiment of the present disclosure may supply air into the tub 2 when rotated at 60 rpm or less. However, it may be difficult to form an air curtain that prevents lint from being generated due to low flow velocity and low flow rate.

Further, when rotating at 60 rpm or more, it is possible to form an air curtain that may prevent lint from being generated.

Further, when rotating 100 rpm or more, it is possible to form an air curtain (or air jet) that may remove the accumulated lint.

The controller 8 may rotate the fan through the fan motor at a rotation speed that is equal to or less than the first rotation speed (e.g. 60 rpm) (sections a, b, and c of FIG. 11). The controller 8 may rotate the fan 91 at a speed lower than the first rotation speed, and then rotate the fan 91 at the second rotation speed (e.g. 200 rpm) that is higher than the first rotation speed (section d of FIG. 11).

For example, the first rotation speed may be in the range of 60 to 100 rpm. For example, the first rotation speed may be 60 rpm.

For example, the second rotation speed may be in the range of 100 to 200 rpm. For example, the second rotation speed may be 200 rpm.

Figure 12:
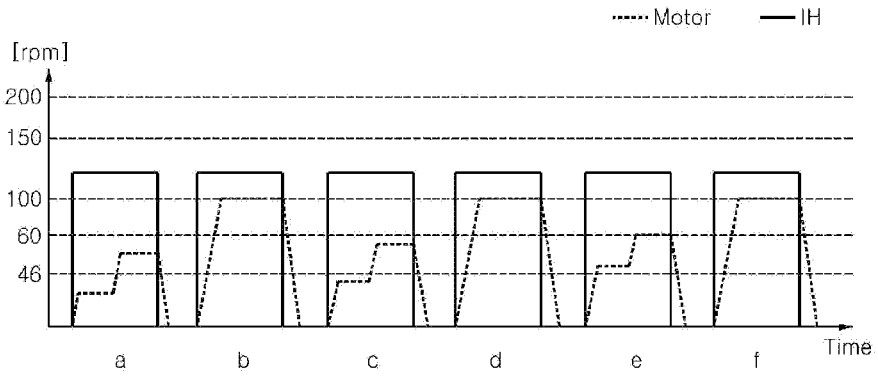
FIG. 12 is a graph illustrating a control method of a clothing treatment apparatus according to an embodiment of the present disclosure, and is a graph illustrating the control of a fan motor that prevents lint from being accumulated.

Referring to FIG. 12, the controller 8 may drive the induction heater 4 to rotate the fan 91 and thereby perform the drying operation. The driving and stopping of the induction heater 4 may be repeated. Further, the rotation and stopping of the fan 91 may be repeated. The driving of the induction heater 4 and the rotation of the fan 91 may be performed in the same time section.

The controller 8 may rotate the fan 91 at a speed that is equal to or less than the preset first rotation speed (e.g. 60 rpm). The controller may rotate the fan 91 at the third rotation speed (e.g. 100 rpm) that is higher than the first rotation speed after the fan 91 is rotated at a speed that is equal to or less than the first rotation speed. The controller 8 may control to alternately repeat the rotation of the fan 91 at the speed that is equal to or less than the first rotation speed or less and the rotation of the fan at the third rotation speed.

For example, the third rotation speed may be in the range of 100 to 200 rpm.

The third rotation speed may be smaller than the second rotation speed. For example, the third rotation speed may be 100 rpm.

Meanwhile, the controller 8 may rotate the drum 3 so that the centrifugal force acting on the laundry in the drum 3 by the rotation of the drum 3 is larger than the gravity, when the induction heater 4 is driven.

For example, the controller 8 may rotate the drum 3 at a speed that is in the range of 60 rpm to 100 rpm.

Meanwhile, referring to FIGS. 6, 10 to 12, the first fan 91 may be operated on the basis of the operation of the induction module 4. Preferably, the first fan 91 may be controlled to be operated simultaneously when the induction module is operated or after the induction module 91 is operated.

The controller 8 may control the first fan 91 on the basis of the operation of the induction module 4 so as to effectively cool the induction module 4 through the first fan 91. Therefore, depending on a target temperature, the driving time of the first fan 91 may be controlled to be the same as the operating time of the induction module 4, and be controlled so that the first fan is operated after a predetermined time after the induction module 4 is operated.

Of course, the first fan 91 may be controlled independently of the induction module 4. During the drying operation of the clothing treatment apparatus, in a state where the drum 3 is sufficiently heated by the induction module 4 to reach the target temperature, the induction module 4 may be intermittently turned on/off. Even in a state where the operation of the induction module 4 is stopped, the drying of the clothing treatment apparatus may be continuously performed. Thus, in order to prevent lint that may be generated during the drying operation from being accumulated, the first fan 91 may be continuously operated.

That is, the first fan 91 and the induction module 4 may be controlled in conjunction with or independently of each other by the controller 8.

During the drying operation of the clothing treatment apparatus, the controller 8 may control the rotation speed of the drum 3 after the induction module 4 is operated. In detail, the controller 8 may control such that the drum 3 is rotated at the first RPM at which the object received in the drum 3 may be attached to the inner circumference of the drum 3 for a predetermined time after the induction module 4 is operated.

The predetermined time may be set differently according to the amount of the object or the target temperature that is set (input) to the clothing treatment apparatus.

Generally, lint is caused by the abrasion of the object. The abrasion of the object may be caused by friction with the inner circumference of the drum while objects collide with each other in the drum or fall from the upper portion of the drum into the drum during the drying operation of the clothing treatment apparatus. Therefore, during the drying operation, a motion in which the object is attached to the inner circumference of the drum to minimize collision between objects or friction with the inner circumference of the drum can be added.

However, in order to minimize the generation of lint, it is not preferable to continuously perform a motion in which the drum 3 rotates at the first RPM. This is because it is difficult to evenly transfer hot air to the object in a state where the object is attached to the inner circumference of the drum 3. Therefore, during the drying operation, when the object is continuously attached to the inner circumference of the drum 3, the generation of lint may be suppressed but the drying efficiency of the object may be deteriorated.

Further, in the structure where the induction module 4 is applied and the drum 3 is directly heated by the induction module 4 as in this embodiment, the drum 3 is maintained at high temperature during the drying operation. Therefore, when the object is continuously attached to the inner circumference of the drum 3, this may cause damage to the object.

Therefore, as described above, a section in which the drum 3 is controlled to be rotated at the first RPM by the controller 8 is preferably performed for a predetermined time during the drying operation. If necessary, this may be intermittently performed multiple times.

As described above, in the case of reaching the target temperature during the drying operation, the induction module 4 may be intermittently turned on/off. Thus, the RPM control of the drum 3 by the controller 8 may be performed independently of the control of the induction module 4.

When the RPM control of the drum 3 is performed independently of the control of the induction module 4, the controller 8 may rotate the drum 3 in the drying operation section at least once at the first RPM independently of the operation of the induction module 4.

Further, during the drying operation of the clothing treatment apparatus, the controller 8 may control to rotate the drum 3 for a predetermined time at the second RPM higher than the first RPM at which the object received in the drum 3 may be attached to the inner circumference of the drum 3, after the induction module 4 is operated.

The predetermined time may be set differently according to the amount of the object or the target temperature that is set (input) to the clothing treatment apparatus.

A section in which the rotation of the drum is controlled at the first RPM may refer to a section in which the object is attached to the inner circumference of the drum 3 to suppress the generation of lint, and a section in which the rotation of the drum is controlled at the second RPM may refer to a section in which strong air flow is created in the drum 3 to remove the lint. However, the RPM control section of the drum is not necessarily divided into a section for preventing lint or a section for removing lint, but both the lint removal and the lint prevention may be performed by the air flow generated according to the RPM control.

Therefore, as the controller 8 controls to rotate the drum 3 at the second RPM, it is possible to remove lint accumulated on the gasket 13 or the tub opening 21.

In detail, when the drum 3 rotates at the second RPM, the flow of air introduced from the tub opening 21 into the drum 3 may be more strongly generated. In this case, the lint on the gasket 13 or the tub opening 21 may be removed by the above-described air flow. Even in this case, it is possible to prevent lint from moving toward and being accumulated in the gasket 13 or the tub opening 21 due to the above-described air flow. Further, since the object is attached to the inner circumference of the drum 3 when the drum 3 rotates at the second RPM, it is possible to suppress the generation of lint.

Meanwhile, it is preferable that a section in which the drum 3 rotates at the second RPM is intermittently performed for a predetermined time, and the reason is similar to that when a section in which the drum 3 rotates at the first RPM is intermittently performed for a predetermined time.

Meanwhile, as described above, the RPM control of the drum 3 by the controller 8 may be performed independently of the operation of the induction module 4, and may be intermittently performed multiple times during the drying operation of the clothing treatment apparatus.

Figure 7:
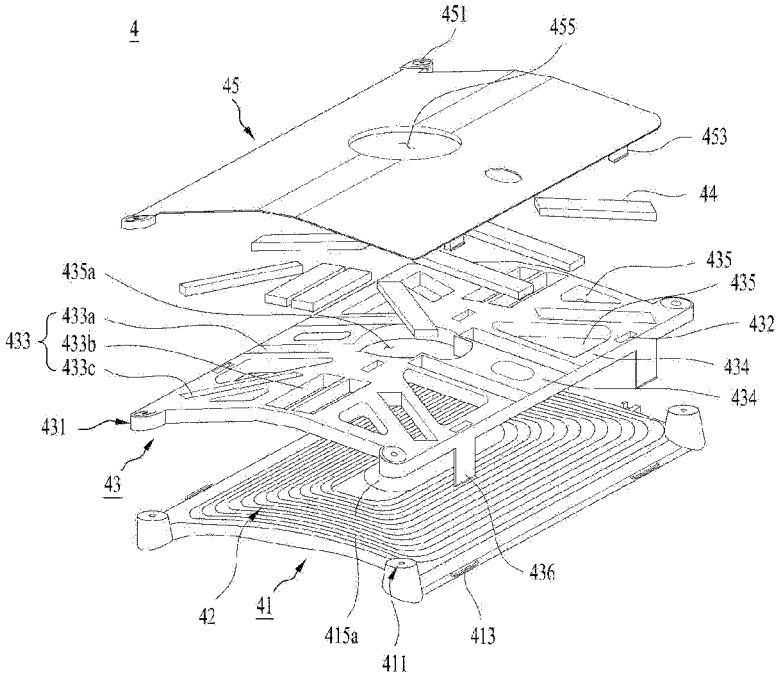
FIG. 7 is a diagram illustrating an induction module.

FIG. 7 is a diagram illustrating an induction module. The induction module of FIG. 7 may further include a permanent-magnet housing 43 receiving a permanent magnet 44 in the induction module 4 described in FIG. 3, and a cover housing 45 coupled to the upper portion of the permanent-magnet housing 43. Hereinafter, this will be described with reference to First, the entire configuration of the induction module 4 will be described.

The induction module 4 may include a base housing 41 that receives the coil 42, a permanent-magnet housing 43 that receives the permanent magnet 44, and a cover housing 45 that covers the permanent-magnet housing 43 to prevent the removal of the permanent magnet 44.

The permanent magnet 44 serves as a blocking member to prevent peripheral components other than the drum 3 from being heated, and concentrates the magnetic field generated in the coil 42 on the drum to enhance heating efficiency.

The base housing 41 may be provided in a substantially quadrangular shape. The quadrangular shape preferably means a rectangular or oblong shape. The coil 42 is received in the upper portion of the base housing 41. A penetration portion 415*a* may be provided in the central portion of the base housing 41.

Preferably, a fastening portion 411 is provided on a corner portion of the base housing 41, and the fastening portion 411 protrudes outward from the corner portion. Further, a ring 413 is provided on the edge of the base housing 41 so that a hook 436 of the permanent-magnet housing 43 is coupled thereto. It is preferable that two rings 413 are provided on each of opposite long sides of the base housing 41, i.e. a total of four rings are provided.

Meanwhile, the permanent-magnet housing 43 is preferably provided in a shape corresponding to the shape of the base housing 41. Thus, the permanent-magnet housing 43 may be provided in the rectangular or oblong shape.

The permanent-magnet housing 43 is provided with a mounting portion 433 in which the permanent magnet 44 is installed. Further, since the permanent-magnet housing 43 is preferably formed of one component, a connecting portion 434 is preferably provided to connect a plurality of mounting portions 433. It is preferable that the connecting portion 434 is vertically opened rather than being vertically blocked so that heat generated from the coil 42 may be dissipated. Thus, the connecting portion 434 is preferably provided with a penetration portion 435 that is vertically opened.

Preferably, a plurality of mounting portions 433 may be provided to extend radially from a portion near the center of the base housing 41 toward the edge. Since the mounting portion 433 is a portion in which the permanent magnet 44 is seated, the mounting portion preferably has a shape corresponding to that of the permanent magnet 44, that is, the shape of a narrow oblong.

To be more specific, the mounting portion 433 may include a long-side mounting portion 433*a*, a short-side mounting portion 433*b*, and a corner mounting portion 433*c*. Two long-side mounting portions 433*a* may be provided on both sides around the center of each long side of the base housing 41. Two short-side mounting portions 433*b* may be provided on both sides around the center of each short side of the base housing 41. Four corner mounting portions 433*c* may be provided to extend from the central portion of the base housing 41 toward the corners.

The penetration portion 435 may be provided to vertically open a portion where no mounting portion 433 is provided, e.g. a space between the mounting portion 433 and a neighboring mounting portion 433. That is, the penetration portion 435 is preferably provided in a shape corresponding to that of the space between the mounting portion 433 and the neighboring mounting portion. Further, since the penetration portion 435 may function to dissipate heat generated from the coil 42, its area is preferably as large as possible as long as the strength of the permanent-magnet housing 43 is maintained.

If high-temperature heat is applied to the permanent magnet 44, atoms lose magnetism while moving in disorder. This may lead to a reduction in durability of the induction module 4.

Therefore, the durability of the induction module can be prevented from being reduced by cooling heat generated from the induction module using the cooling path structure by the above-described duct.

Meanwhile, the fastening portion 431 is provided on the corner portion of the permanent-magnet housing 43, and the fastening portion 431 protrudes outward from the corner portion.

The hook 436 is provided on the edge of the permanent-magnet housing 43 to extend downward, and the hook 436 is inserted and coupled to the ring 413 of the base housing 41. Further, a groove 432 is provided at a predetermined position in the permanent-magnet housing 43, and the groove 432 is coupled to the hook 433 of the cover housing 45.

Preferably, the cover housing 45 has a shape substantially corresponding to that of the permanent-magnet housing 43. For example, the cover housing 45 preferably has a rectangular shape. The penetration portion 455 is formed in the center of the cover housing 45, and the penetration portion 455 allows outside air to be introduced or allows heat generated from the coil to be dissipated.

Preferably, the fastening portion 451 is provided on the corner portion of the cover housing 45, and a hole of the fastening portion 451 is an elongated hole. The hook 453 is provided on the lower portion of the cover housing 45 to be coupled to the groove 432 of the permanent-magnet housing 43.

When the induction module 4 is provided with the permanent-magnet housing and the cover housing as shown in FIG. 7, the first fan housing 110 may be formed in a location corresponding to the penetration portions 455, 435*a*, and 415*a* of the base housing, the permanent-magnet housing, and the cover housing to supply outside air, thus cooling heat that is generated from the coil.

Figure 8:
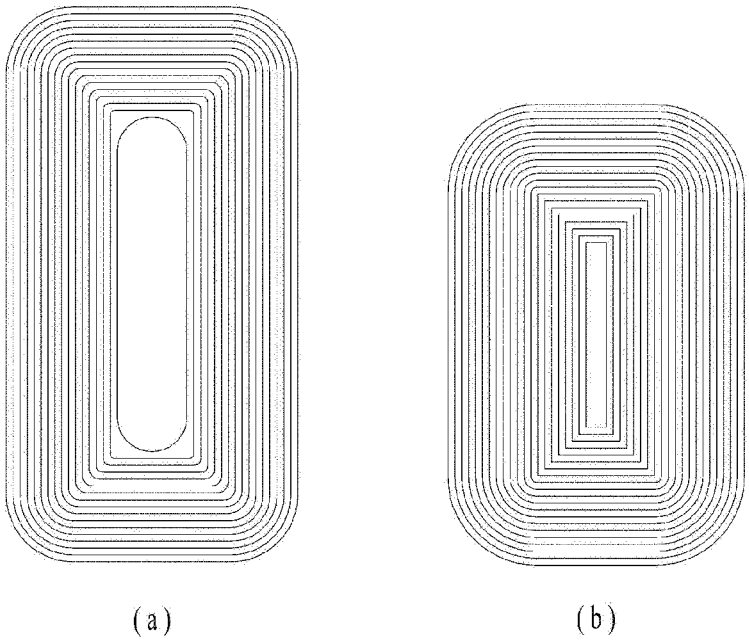
FIG. 8 is a diagram illustrating various shapes of coils.
Figure 9:
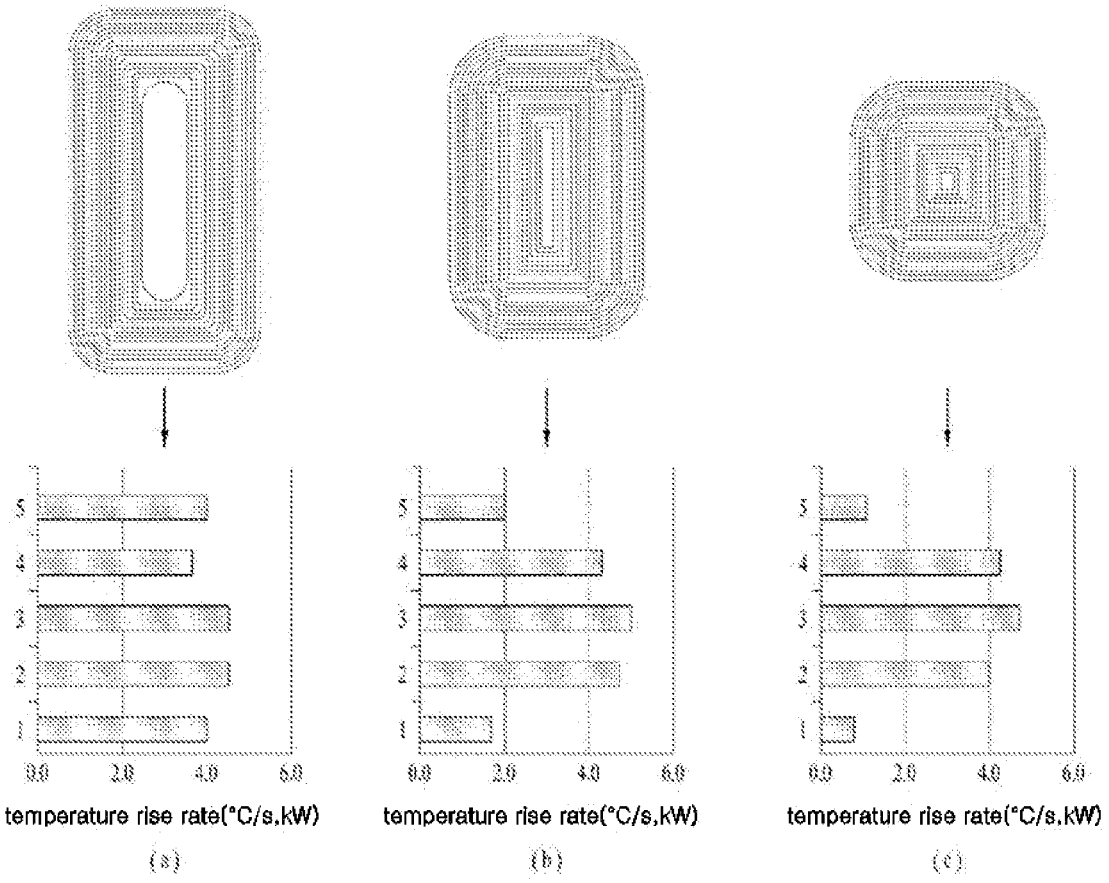
FIG. 9 is a graph illustrating a temperature rise rate for each position of a drum according to the shape of a base housing on which a coil is mounted.

FIG. 8 is a diagram illustrating various shapes of coils, and FIG. 9 is a graph illustrating a temperature rise rate for each position of the drum according to the shape of the base housing on which the coil is mounted.

Hereinafter, the shape of the coil will be described with reference to FIG. 8.

The coil 42 may be provided in any shape as long as wire is wound on the outer circumference of the tub 2, such as the shape of a concentric circle, an ellipse, or a track to form the coil 42, but a degree to which the drum 3 is heated may vary depending on the wound shape.

The reason is as follows: when the inner coil and the outer coil are formed to be different from each other in the curvature radius of a curved portion, like the shape of the coil disclosed in (b) of FIG. 8, the amount of magnetic field transmitted to the center of the drum 3 and the amount of magnetic field transmitted to the front and rear may be significantly different from each other.

In other words, since the area of the coil located near the front and rear of the drum 3 is formed narrow, the amount of magnetic field transmitted to the front of the circumferential surface of the drum 3 may be inevitably relatively small. Since the area of the coil located in the central portion is large, the amount of magnetic field transmitted to the central portion of the circumferential surface of the drum 3 may be inevitably relatively large. Therefore, it is difficult to uniformly heat the drum 3.

Therefore, as shown in (a) of FIG. 8, the wire may be wound such that the coil 42 is provided with straight portions and curved portions connecting the straight portions, and the curvature radius of the wire forming the curved portion is preferably formed such that inner and outer coils are the same as each other.

It can be seen that the coil of (a) of FIG. 8 and the coil of (b) of FIG. 8 are significantly different from each other in the coil area in the corner portion.

A relationship between the straight portion and the curved portion will be described in detail. The straight portion may include a horizontal straight portion having a front straight portion that is provided on the front of the outer circumference of the tub 2 and a rear straight portion that is provided on the rear of the outer circumference of the tub 2, and a vertical straight portion that is formed to be perpendicular to the horizontal straight portion. The curved portion is formed in a point where the horizontal straight portion and the vertical straight portion meet.

That is, by the above-described straight portion and curved portion, the coil 42 of this embodiment forms a long side from front to rear of the tub 2 on the circumferential surface of the tub body 22 and forms a short side from left to right of the tub 2, and the corner portion connecting the long side and the short side is provided in a curved line, so that the coil may be provided in the shape of a track.

According to the above-described shape of the coil 42, both ends including a coil front end adjacent to the front of the tub 2 and a coil rear end adjacent to the rear of the tub 2, and a coil central portion located between both ends of the coil may be formed to have a uniform horizontal width. As a result, the amount of magnetic field emitted from both ends of the coil to the front and rear on the circumferential surface of the drum 3 is similar to the amount of magnetic field emitted from the central portion of the coil to the center on the circumferential surface of the drum 3.

Therefore, both the center and the front and rear of the circumferential surface of the drum 3 can be uniformly heated.

As described above, since the coil 42 is provided in the shape of the track having long sides from front to rear of the tub 2 and the induction module 4 is provided to correspond to the shape of the coil 42, the first duct 10 may extend from front to rear in the longitudinal direction of the tub 2 to receive the induction module 4.

Hereinafter, the temperature distribution of the drum according to the coil shape will be described with reference to FIG. 9.

FIG. 9 shows the coils 42 having different vertical lengths and the heat distribution of the circumferential surface of the drum 3 according to the vertical width of the coil 42.

In the graph, the vertical axis indicates each position of the drum, '1' indicates the rear of the outer circumference of the drum, '5' indicates the front of the outer circumference of the drum 3, and '2 to 5' indicate sections therebetween. Further, the horizontal axis indicates the temperature rise rate of the drum 3.

Hereinafter, the vertical width of the described coil 42 and the temperature rise rate of the drum 3 are relatively compared for each coil 42 disclosed in FIG. 9. In (a) of FIG. 9, the drum is heated using the coil that is widest in vertical width, in (b) of FIG. 9, the drum is heated using the coil that has a medium vertical width, and in (c) of FIG. 9, the drum is heated using the coil that is narrowest in vertical width.

The coil of (a) of FIG. 9 shows a temperature rise rate that is uniform in the front and rear and the center of the drum 3 compared to other coils, the coil of (c) of FIG. 9 has a significant difference in the temperature rise rate between the front and rear and the center of the drum 3, and the coil of (b) of FIG. 9 shows a relatively large difference in the temperature rise rate.

That is, it can be seen that the front and rear and the center of the drum 3 may be relatively uniformly heated as the vertical width of the coil 42 increases, on the assumption that the horizontal width of each coil 42 is the same. That is, the major axis of the coil in the shape of an ellipse or a track is preferably formed in the front-rear direction of the tub 2.

When this is interpreted as a case where the coil 42 is provided on the outer circumference of the tub 2, it can be seen that, the closer both ends of the coil 42 are provided to the front of the tub 2, the more uniform the circumferential surface of the drum 3 provided in the tub 2 is heated.

Meanwhile, if the outermost wire of the horizontal straight portion is provided to extend to the front and rear of the tub 2, the drum 3 may be more uniformly heated. However, in this case, since the magnetic field excessively extends to the front and rear to heat other components of the clothing treatment apparatus such as the driving unit 6 or the door 12, the clothing treatment apparatus may be damaged.

Further, in the case of the clothing treatment apparatus 1 in which the rear of the tub 2 is tilted inside the cabinet 1, the upper corner of the front of the induction module 4 and the upper surface of the cabinet 1 interfere with each other while the tub 2 vibrates up and down, thus causing a problem in which the induction module 4 and the cabinet 1 are damaged. When the height of the cabinet 1 is increased to prevent this problem, the compact structure of the clothing treatment apparatus may not be realized.

Therefore, the outermost wire of the front straight portion is spaced apart from the foremost portion of the tub 2 by a predetermined distance, and the outermost wire of the rear straight portion is spaced apart from the rearmost portion of the tub 2 by a predetermined distance. The predetermine distance preferably ranges from 10 to 20 mm.

The above-described configuration prevents a problem in which components other than the drum 3 are unnecessarily heated or the induction module 4 interferes with the upper surface of the inside of the cabinet 1, and has the effect of uniformly heating the outer circumference of the drum 3.

Moreover, the length of the outermost wire of the vertical straight portion of the coil 42 is preferably longer than the length of the outermost wire of the horizontal straight portion.

This prevents the magnetic field from being emitted to an excessively wide range in the circumferential direction of the drum 3, thus preventing components other than the drum 3 from being heated, and securing a space for arranging a spring or other components that may be provided on the outer circumference of the tub 2.

At this time, a surface formed by the coil 42 by winding the wire may be provided as a curved surface corresponding to the circumferential surface of the drum 3. In this case, it is possible to further increase the magnetic flux of the magnetic field toward the drum 3. Moreover, when the induction module 4 is operated, it may be preferable that the circumferential surface of the drum 3 is uniformly heated by rotating the drum 3.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothing treatment apparatus comprising:

a cabinet having an inlet;

a door rotatably connected to the cabinet to open and close the inlet;

a drum rotatably located inside the cabinet, the drum having a cylindrical shape and an opening that faces the inlet of the cabinet;

a tubular extension portion extending from the inlet of the cabinet toward the drum;

a first duct located outside the drum;

an induction heater located inside the first duct to heat the drum, the induction heater having a coil;

a first fan configured to supply outside air to an inside of the first duct; and a second duct having an inlet connected to the first duct, and an outlet connected to an outer circumference of the extension portion, wherein the second duct extends from the first duct along a radially inward direction of the drum, and wherein the outlet of the second duct has a smaller area than an area of the inlet of the second duct.

2. The clothing treatment apparatus of claim 1, wherein the second duct has a first width in a longitudinal direction of the drum, and a second width in a radial direction of the drum, and wherein the first width of the second duct is smaller than the second width of the second duct.

3. The clothing treatment apparatus of claim 1, wherein a width of the outlet of the second duct is smaller than a width of the inlet of the second duct.

4. The clothing treatment apparatus of claim 1, further comprising a fan housing receiving the first fan, the fan housing being in communication with the first duct, wherein the fan housing and the second duct are located at opposite sides of the first duct with respect to a center of the first duct.

5. The clothing treatment apparatus of claim 4, wherein the first duct is located on an upper side of the drum, wherein the second duct extends downward from the first duct, and wherein the fan housing is located on an upper side of the first duct.

6. The clothing treatment apparatus of claim 4, wherein the fan housing and the second duct are located on opposite sides of the first duct with respect to the center in a longitudinal direction of the first duct.

7. The clothing treatment apparatus of claim 1, further comprising:

an exhaust port in communication with an inside of the drum; and a third duct in communication with the exhaust port and an outside of the cabinet.

8. The clothing treatment apparatus of claim 7, further comprising a second fan configured to supply air from the drum to outside of the cabinet through the third duct.

9. The clothing treatment apparatus of claim 1, further comprising a tub provided inside the cabinet, the tub having an opening facing the inlet of the cabinet, wherein the drum is located in the tub, and wherein the first duct is located on an outer surface of the tub.

10. The clothing treatment apparatus of claim 9, wherein the extension portion comprises a gasket connecting the inlet of the cabinet and the opening of the tub, and wherein the outlet of the second duct is connected to an outer circumference of the gasket.

11. The clothing treatment apparatus of claim 9, further comprising:

an exhaust port located in the tub; and a third duct in communication with the exhaust port and the outside of the cabinet.

12. The clothing treatment apparatus of claim 11, wherein a length of the coil in a longitudinal direction of the drum is greater than a width of the coil in a radial direction of the drum.

13. A clothing treatment apparatus comprising:

a cabinet having an inlet;

a door rotatably connected to the cabinet to open and close the inlet;

a tub located inside the cabinet, the tub having an opening facing the inlet of the cabinet;

a drum rotatably located inside the tub, the drum having a cylindrical shape and an opening that faces the inlet of the cabinet;

a tubular extension portion extending from the inlet of the cabinet toward the drum;

a first duct located on an outer surface of the tub;

an induction heater located inside the first duct to heat the drum, the induction heater having a coil;

a first fan configured to supply outside air to an inside of the first duct;

a second duct having an inlet connected to the first duct and an outlet connected to an outer circumference of the extension portion;

an exhaust port located in the tub; and a third duct in communication with the exhaust port and the outside of the cabinet.

14. The clothing treatment apparatus of claim 13, wherein the second duct has a first width defined in a longitudinal direction of the drum, and a second width defined in a radial direction of the drum, and wherein the first width of the second duct is smaller than the second width of the second duct.

15. The clothing treatment apparatus of claim 13, wherein a width of the outlet of the second duct is smaller than a width of the inlet of the second duct.

16. The clothing treatment apparatus of claim 13, further comprising a fan housing receiving the first fan, the fan housing being in communication with the first duct, wherein the fan housing and the second duct are located at opposite sides of the first duct with respect to a center of the first duct.

17. The clothing treatment apparatus of claim 16, wherein the second duct extends downward from the first duct, and wherein the fan housing is located on an upper side of the first duct.

18. The clothing treatment apparatus of claim 16, wherein the fan housing and the second duct are located on opposite sides of the first duct with respect to the center in a longitudinal direction of the first duct.

19. The clothing treatment apparatus of claim 16, wherein the extension portion comprises a gasket connecting the inlet of the cabinet and the opening of the tub, and wherein the outlet of the second duct is connected to an outer circumference of the gasket.

20. The clothing treatment apparatus of claim 13, wherein a length of the coil in a longitudinal direction of the drum is greater than a width of the coil in a radial direction of the drum.

* * * * *